United States Patent [19]

Lacoste

[11] Patent Number: 4,917,633

[45] Date of Patent: Apr. 17, 1990

[54] SEPARABLE CONNECTION DEVICE BETWEEN A CONDUCTING LUG AND AT LEAST ONE CONNECTION WIRE

[75] Inventor: Albert Lacoste, Aulnat, France

[73] Assignee: Centre National D'Etudes des Telecommunications, Issy Les Moulineaux, France

[21] Appl. No.: 244,884

[22] Filed: Sep. 15, 1988

[30] Foreign Application Priority Data

Sep. 18, 1987 [FR] France ..... 87 12977

[51] Int. Cl.[4] ..... H01R 9/22

[52] U.S. Cl. ..... 439/722; 439/936; 439/402; 439/413

[58] Field of Search ..... 439/411–414, 439/417–419, 708, 711, 801, 811, 727, 728, 709, 725, 395, 397, 402, 403, 797, 722, 936

[56] References Cited

U.S. PATENT DOCUMENTS

| | | | |
|---|---|---|---|
| 2,672,595 | 3/1954 | Barr | 439/727 |
| 2,740,100 | 3/1956 | Broverman | 439/728 |
| 3,960,427 | 6/1976 | Piaget et al. | 439/801 |
| 4,614,396 | 9/1986 | Saligny | 439/395 |
| 4,645,285 | 2/1987 | Cozzins et al. | 439/395 |

FOREIGN PATENT DOCUMENTS

| | | | |
|---|---|---|---|
| 481232 | 2/1952 | Canada | 439/411 |
| 2144322 | 1/1973 | France . | |
| 460106 | 9/1968 | Switzerland | 439/411 |
| 618755 | 2/1949 | United Kingdom | 439/411 |
| 2115992 | 9/1983 | United Kingdom . | |

*Primary Examiner*—David Pirlot

*Attorney, Agent, or Firm*—Pollock, VandeSande & Priddy

[57] ABSTRACT

A separable connection device between a conducting lug and at least one connecting wire. The device includes means for providing an electric connection between at least one jumper cable wire having a conducting core surrounded by an insulating sheath and a conducting clamp. The conducting clamp is formed with at least one cutting slit adapted for cutting the sheath of the wire during the introduction of said wire in the slit and establishing a contact with the wire conducting core. Additional means are provided for providing the electric connection between the clamp and the lug, and means for causing the progressive engagement of the clamp on the wire.

7 Claims, 4 Drawing Sheets

SEPARABLE CONNECTION DEVICE BETWEEN A CONDUCTING LUG AND AT LEAST ONE CONNECTION WIRE

FIELD OF THE INVENTION

The present invention relates to a separable electrical connection device, mounted between a conducting lug permanently connected to a cable element and at least one connection wire linking the lug to an other similar lug, situated at a distance from the first.

Particularly in the telephone installations, it is frequently necessary to establish a temporary or permanent connection between a lead-in and a lead-out, for example for connecting a transmission line to the installation of a telephone subscriber. If the lead-in cables are normally distributed to an assembly of connection lugs mounted in a fixed manner in supports or subdistribution blocks, it is usual to connect the corresponding lugs between transmission lines and telephone subscriber installations by means of flexible conductors called "jumper cables". The cables have to be easily connected and in particular have to allow modifications to their position, for example when the subscriber moves to a different address or as a function of particular arrangements of the distribution network.

BACKGROUND OF THE INVENTION

In the previous solutions, the subdistribution blocks are made of supports reached by lugs to be connected by the jumper cables. The conducting wires of the latter extend transversely through passages formed in the support in order to be fixed on each of the corresponding lugs. They are wound on said lugs and fixed by a nut screwed on the threaded end of the chosen lug.

But such solutions are not well adapted. Indeed, they are not easy to use. Each connection (a jumper cable includes at least two wires, which means that at least four lugs have to be connected two by two), makes it necessary to strip the end of a wire and to fix it to the associated lug. In addition, the connections thus made are generally made in the open-air and are subjected to working conditions which can cause an oxidation of the electric contacts due to the ambient moisture. This creates detremental shorts and generally spurious noise (crackling) on the lines.

OBJECTS AND SUMMARY OF THE INVENTION

The present invention is directed to a separable connecting device whereby the connection of one or several jumper cables with the conducting lugs of a subdistribution block can be easily made, while avoiding the disadvantages of the solutions already known.

To this end, the device is characterized in that it includes means adapted for providing an electric connection between at least one jumper cable wire having a conducting core surrounded by an insulating sheath, and a conducting clamp formed with at least one cutting slit adapted for cutting the wire sheath during the introduction of said wire in the slit establishing contact with the wire conducting core. Means provided for the electric connection between the clamp and the lug. Still other means cause the progressive engagement of the clamp on the wire.

Advantageously, each slit formed in one arm of the clamp includes a widened portion for the positioning of the wire prior to its engagement in the clamp cutting slit.

According to a particular feature of the invention, the conducting clamp is housed in a casing receiving the conducting lug, said casing being provided for containing a filling of insulating protection material, surrounding the clamp and the wire. Preferably, the insulating material is made of a petroleum gel.

In a first alternative embodiment, each conducting lug includes a threaded end-piece on which is screwed a nut causing the displacement of the clamp inside the housing of its casing. Advantageously, the nut is formed with a protruding flange, extending through a hole formed in the clamp between the wings of the clamp, where the lug threaded end on which the nut is screwed is engaged, so that the removal of the nut, once it has been unscrewed from the lug, entrains the clamp outside the casing.

In this alternative embodiment, the wires of the jumper cable extend into transverse passages formed in the clamp casing.

In another alternative embodiment, each clamp includes a male or female prolongation, which is forcibly engaged on a respectively female or male portion provided at the end of a connection lug. The clamp is enclosed in a casing independent of the lugs and includes a bottom and a cover, the setting in position of the cover against the bottom ensuring the engagement of the connection wires in the clamp cutting slits.

According to another particular feature of the invention, the prolongation of the clamp projects outside the apparent outline of the casing. As an alternative, the conducting lugs extend directly inside the casing.

BRIEF DESCRIPTION OF DRAWINGS

Other features and advantages of a separable connection device formed according to the invention will become more apparent from the following description of two embodiments given by way of example only, with reference to the accompaying drawings wherein.

DETAILED DESCRIPTION OF THE INVENTION

Figure 1:
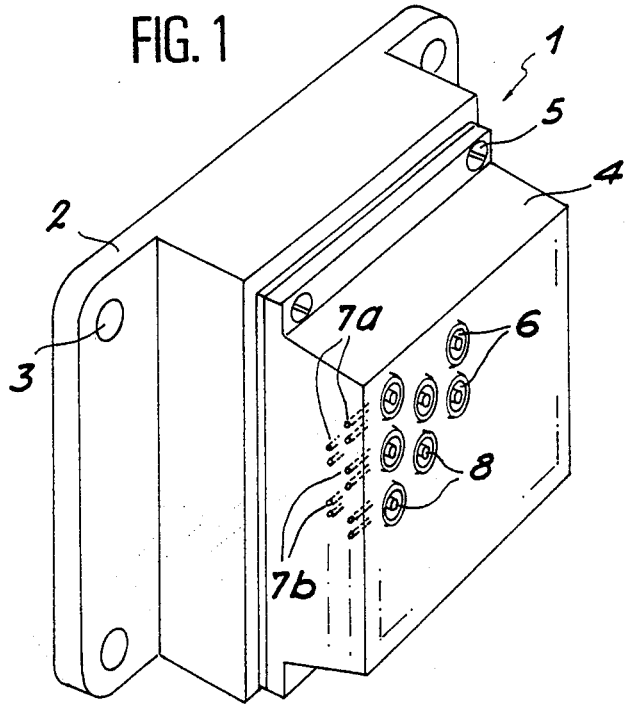
FIG. 1 is a perspective schematic view of a distribution block including a casing designed for receiving connection devices according to the invention.

In FIG. 1, reference numeral 1 designates a standard distribution block as a whole, including notably a base 2 for its fixation on a support (not shown) via screws extending through holes formed in the angles of the base. In the front, the distribution block includes a casing 4, fixed on base 2 by means of screws 5. The casing 4 includes on its frontal face housings 6 open to the outside and in its lateral sides transverse passages 7*a* and 7*b* for the mounting of the wires of the connection jumper cables. In this respect, it should be noted that in each housing 6 open two transverse passages 7*a* and 7*b* provided on the same side of casing 4. Thus, the second passage can be used when the connection is a Y-connection, that is in the case where a second jumper cable has to be connected to a determined lug.

Figure 2:
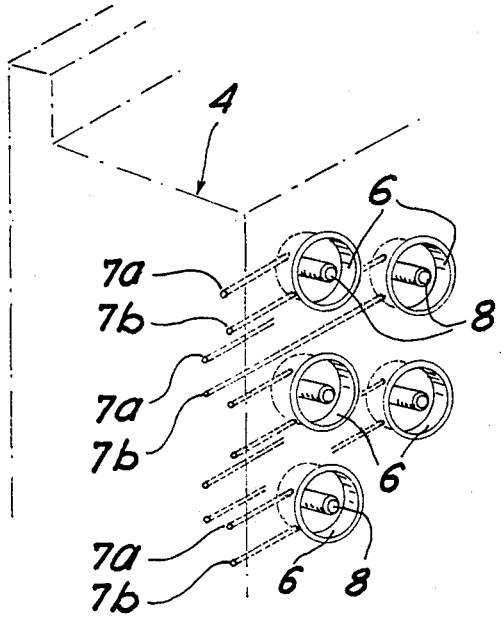
FIG. 2 is a partial perspective view at a different scale of the particular casing provided on said distribution block.

As is shown explicitly in the schematic illustration of FIG. 2, an axial lug 8 extends into each of the housings 6. The lug being connected by any standard means to the end of a line 9, notably for telephone uses. In the transverse passages 7*a*, 7*b* of casing 4 are on the other hand engaged the connection wires 11a and 11b of a jumper cable used for establishing the connection with another distribution block of standard type or similar of a determine line, for example for connecting the latter to an appropriate telephone subscriber installation.

Figure 3:
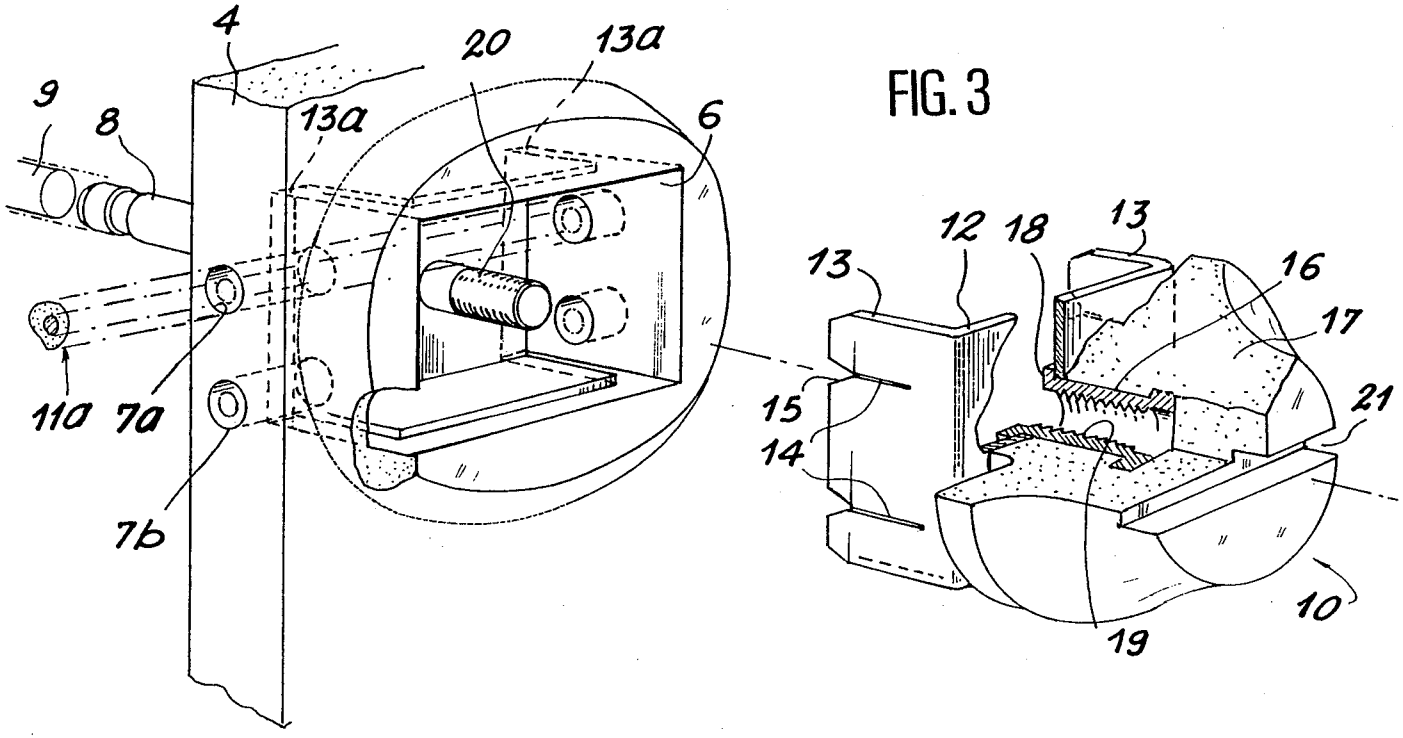
FIG. 3 is a perspective view at a larger scale of a particular embodiment of the device according to the invention, which permits ensuring the connection between the wires of the jumper cable and the aforementioned connection lugs.
Figure 6:
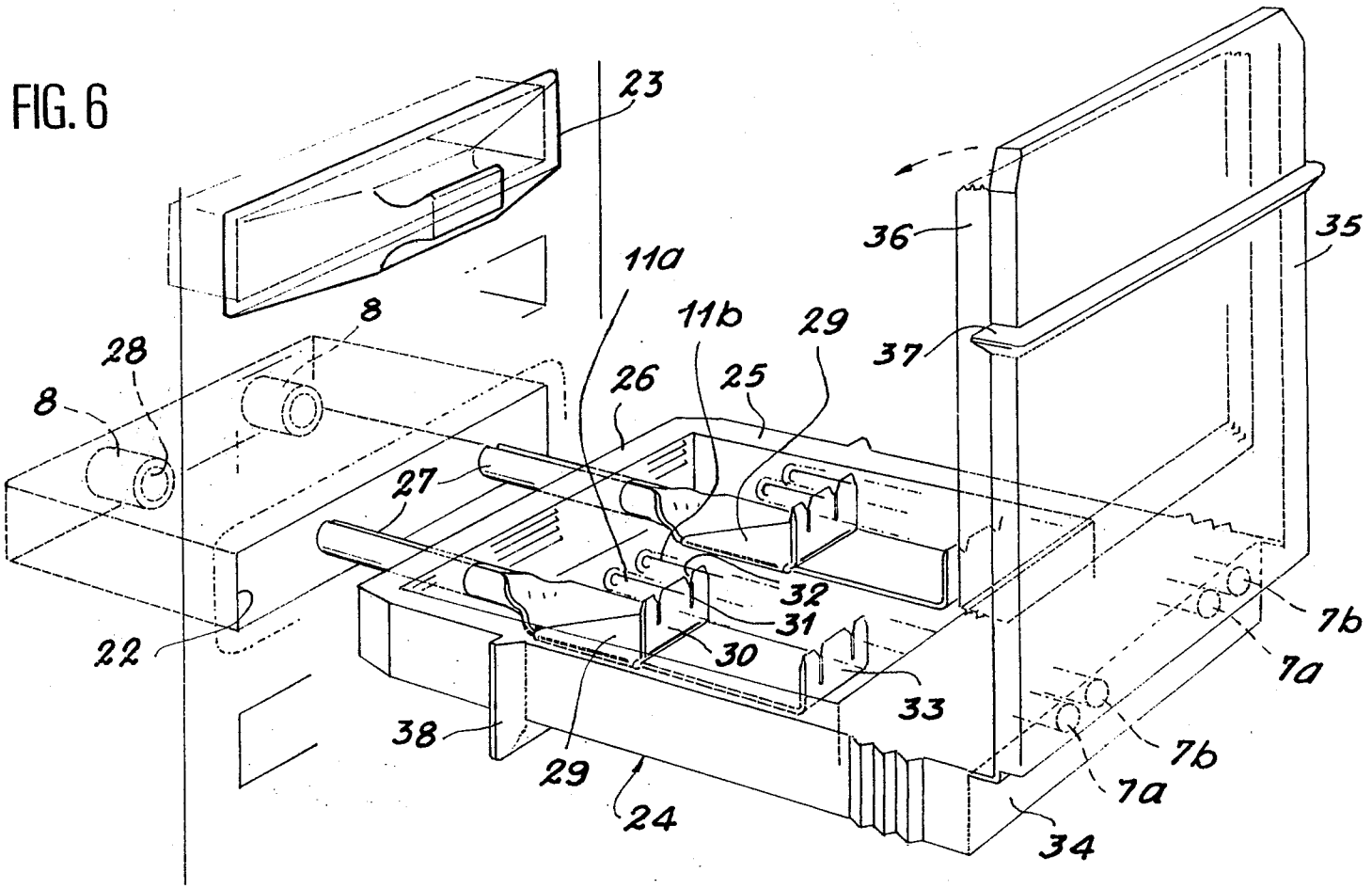
FIG. 6 is a perspective view of the constituent elements of one of the connection devices provided in this embodiment.

According to the invention, the electric connection is established in a quick and safe way by means of a connection device 10 which can be easily set in position or separated from casing 4, FIGS. 3 and 6 showing respectively two alternative embodiments thereof.

In the example according to FIG. 3, one sees again in one of the housings 6 of casing 4 one of the connecting lugs 8 as well as a wire 11*a* of the corresponding jumper cable, shown introduced in one of the transverse passages 7*a* of said casing, said wire extending through the housing 6 perpendicularly to the direction of lug 8.

According to the invention, the connection between a lug and the wires of a jumper cable is provided by means of a clamp 12 in the shape of a staple with its middle portion adapted for being engaged on the corresponding lug 8 by being placed perpendicularly to the lug. Regarding the side arms 13 of the clamp, they are placed parallel to the lug, and therefore perpendicularly to the passages 7*a*, 7*b* provided for the introduction of the wires of the corresponding jumper cable. The wings 13 are formed at the level of wires 11*a*, 11*b* of the jumper cable with cutting slits 14 adapted for cutting the insulating sheath of wires 11*a*, 11*b* and for reaching the core of said wires, thereby providing the continuity of the electric connection with lug 8.

The penetration movement of the clamp 12 inside the sheath of wires 11*a*, 11*b* is made easy by providing in the wings 13, in alignment with the cutting slits 14, a widened zone 15. On the other hand, means adapted for causing this penetration movement are provided. To this effect, the central portion of clamp 12 is rigidly connected to a metallic sleeve 16 on which is mounted an actuation knob 17 of a plastic or other material. This sleeve is formed with a flange 18 extending underneath the clamp in such manner that said clamp and knob 17 are rigidly connected in axial displacement but that the knob can rotate freely when the clamp 12 is getting engaged in housing 6. To this effect, sleeve 16 includes an inner thread 19 adapted for cooperating with the thread 20 formed at the end of lug 8. The rotation of knob 17 via a control tool of the screwdriver type engaged in a slot 21 allows rotating simultaneously sleeve 16 which is screwed onto the lug and causing the desired progressive engagement of clamp 12 between the cores of said wires and the lug.

Advantageously, the free space between clamp 12 and housing 6 inside which the clamp is engaged is filled with an appropriate insulating material of the petroleum gel type. Moreover, the bottom of each housing 6 includes two recesses 13*a* adapted for receiving the ends of the side wings 13 of the corresponding connection clamp 12.

On the other hand and as is shown in FIG. 1, there can exist on the sides of casing 4 two series of transverse passages 7*a* and 7*b* reaching two distinct series of housings 6 occupying positions which are offset on the body of casing 4. Consequently, there exists two different types of connection clamps 12 which are different as to the length of their side wings 13, those of the clamps which have to cooperate with wires 11*a*, 11*b* placed in the passages 7*a*, 7*b* which are most remote from the frontal face of casing 4 being longer than the wings 13 of the other series of connection clamps.

Figure 5:
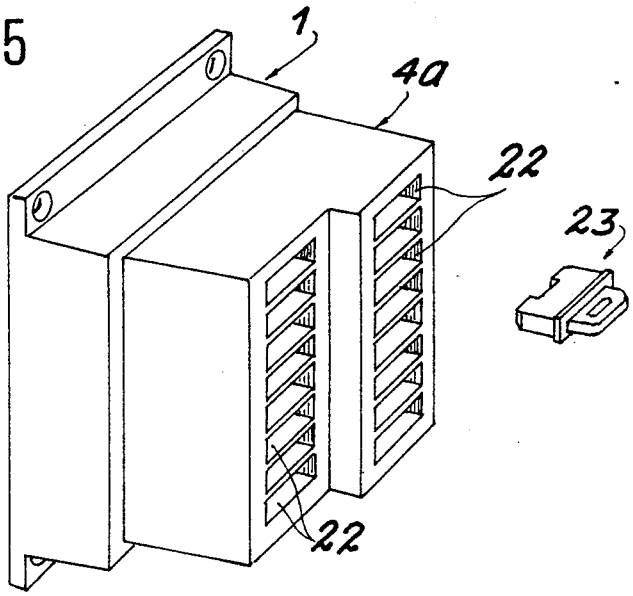
FIG. 5 is a perspective view of another embodiment of the casing provided for receiving connection devices according to the invention.

In another embodiment shown in FIGS. 5 and 6, there is provided a casing 4*a* formed with a series of superimposed cells 22 inside each of which are placed two lugs 8 connected to lines which are not shown. The cells can be distributed into two distinct vertical rows, the frontal face of casing 4*a* being formed with a step between these two rows.

When no connection is made in a cell 22, this cell is closed by a closing cap 23. Once this cap is removed, the connection between the wires 11*a* and 11*b* of a jumper cable and the lug 8 of the corresponding cell 22 is formed by a socket 24 including side walls 25 and an inner face 26, through which extend hollow stems 27. In the example in consideration, the number of these stems is two and they are adapted to be engaged, by establishing the desired electrical connection, inside bores 28 formed axially in lugs 8.

The hollow stems 27 are prolongated inside the socket 24 by a clamp 29 having a perpendicular edge 30 formed with vertical cutting slits 31, said slits having at their ends widened zones 32 for making easy the engagement of wires 11*a* and 11*b*, the insulating sheath of which is then stripped by the slits 31, and the electric connection with the lugs being thus established. Advantageously, clamp 29 presents two parallel edges 30 and 33. As regards the chest of the socket 24, it is formed with a bottom 34 including passages 7*a* and 7*b* for the introduction of the wires of the jumper cable. A hinged cover 35 supports, toward the inside of the socket, a pushing plaquette 36 adapted to bear on the wires 11*a* and 11*b* and to drive them inside the cutting slits 31 of clamp 29 when the socket is being closed by the cover. Abutments 37 and 38 are preferably formed on cover 35 for limiting the driving in of said cover and the penetration of the socket 24 in casing 22. The inside of socket 24 is preferably filled as in the previous example with an insulating petroleum gel.

Figure 4:
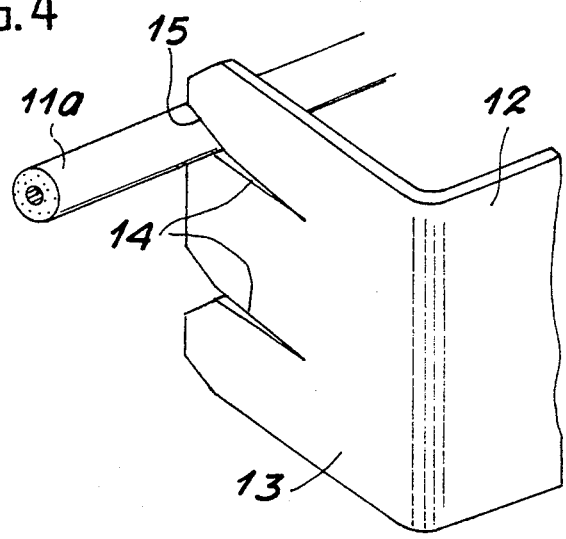
FIG. 4 is a perspective schematic view showing the engagement mode of a connection clamp on the conducting wires of a jumper cable.

On the other hand, and as is shown in FIG. 4, each socket 24 includes two connection clamps 29 for a possible Y-connection, that is for the mounting of a second jumper cable.

In this embodiment as well as in the preceding one, there is provided a very simple connection device, allowing connecting in a safe and quick manner the wires of a jumper cable and the connecting lugs of a distribution block, by engagement of a socket in an appropriate housing of a casing, said socket carrying at least one cutting clamp stripping the insulating sheath of said wires for establishing the desired electrical contact and/or interrupting said contact as required, according to the connections to be established. In particular, the invention is not limited to the shape of the housing and of the clamps with cutting slits which can be provided in various manners without modifying the process used. The arrangements which are envisaged lead in all cases to an excellent tightness of the used casings or connection sockets, while avoiding the effects of moisture, the clamps with cutting slits being received inside closed units and imbedded in an appropriate insulating material.

Obviously, the invention is not limited to the only examples more especially described and shown; and it encompasses all the variants thereof.

What I claim is:

1. A separable connection device comprising:

a casing open at one end to receive a wire clamp, said casing including an aperture for receiving at least one sheathed wire, extending into the casing parallel to said open end;

a lug threaded at one end supported by said casing perpendicular to a plane of said one end;

a wire clamp having first and second spaced apart wings connected by a central portion, each wing bearing on an edge a cutting slit, for engaging a sheathed wire, said central portion including an opening for receiving said lug; and, an actuation member axially fixed to said wire clamp, including a plurality of inside threads disposed over said opening engaging said lug threads, said member engaging said lug threads forcing said cutting slit into engagement with said sheathed wire, whereby an electrical connection is made between said wire, clamp and lug.

2. The separable connection device of claim 1 wherein said casing includes in an end opposite said open end, first and second spaced apart recesses for receiving said spaced apart wings.

3. A device according to claim 1, wherein each slit formed in the clamp includes a widened portion for positioning the wire prior to its engagement in the clamp cutting slit.

4. A device according to claim 1 wherein the conducting clamp is housed in said casing, said casing being provided with insulating protection material, surrounding the clamp and the wire.

5. A device according to claim 4, wherein the insulating material is made of a petroleum gel.

6. A device according to claim 1, wherein said actuating member is formed with a protruding flange, extending through said opening formed in the clamp between first and second wings of said clamp receiving the threaded end of the lug.

7. A device according to claim 1, wherein said wire extends inside transverse passages formed in the casing, extending into the casing perpendicular to the lug, said clamp being in the shape of a staple, with side wings formed with and cutting slits adapted for cutting the sheath of the wire.

* * * * *